US011044553B2

(12) United States Patent
Jenq

(10) Patent No.: US 11,044,553 B2
(45) Date of Patent: Jun. 22, 2021

(54) TWO-WAY QUASI POINT-SOURCE WIDE-DISPERSION SPEAKER

(71) Applicant: Cheng Yih Jenq, Piscataway, NJ (US)

(72) Inventor: Cheng Yih Jenq, Piscataway, NJ (US)

( * ) Notice: Subject to any disclaimer, the term of this patent is extended or adjusted under 35 U.S.C. 154(b) by 0 days.

(21) Appl. No.: 16/830,385

(22) Filed: Mar. 26, 2020

(65) Prior Publication Data

US 2020/0329306 A1 Oct. 15, 2020

Related U.S. Application Data

(60) Provisional application No. 62/824,518, filed on Mar. 27, 2019.

(51) Int. Cl.
*H04R 1/40* (2006.01)
*H04R 1/02* (2006.01)

(52) U.S. Cl.
CPC ..... *H04R 1/403* (2013.01); *H04R 1/025* (2013.01); *H04R 2201/401* (2013.01)

(58) Field of Classification Search
CPC ... H04R 1/403; H04R 1/025; H04R 2201/401
USPC ..... 381/182
See application file for complete search history.

(56) References Cited

U.S. PATENT DOCUMENTS

| | | | | |
|---|---|---|---|---|
| 3,842,203 | A * | 10/1974 | Weisberg | H04R 1/30 381/342 |
| 4,890,689 | A * | 1/1990 | Smith | H04R 1/227 181/144 |
| 5,889,876 | A * | 3/1999 | Billings | H04R 1/345 181/144 |
| 6,038,330 | A | 3/2000 | Meucci, Jr. | |
| 8,249,268 | B2 | 8/2012 | Jenq | |
| 8,917,881 | B2 | 12/2014 | Jenq | |
| 2006/0204016 | A1 | 9/2006 | Pham et al. | |
| 2008/0212805 | A1* | 9/2008 | Fincham | H03G 3/004 381/160 |
| 2009/0245535 | A1* | 10/2009 | Van Dijk | H04R 3/12 381/99 |

* cited by examiner

*Primary Examiner* — Sean H Nguyen
(74) *Attorney, Agent, or Firm* — Gerald E. Hespos; Michael J. Porco; Matthew T. Hespos

(57) ABSTRACT

A speaker system includes drivers, each of which has a front face, a rear face and an axis of symmetry extending through the front and rear faces. The drivers are mounted to a frame so that the axes of symmetry of the drivers converge on a single center point, with the front faces of the drivers facing toward the single center point. The frame and the drivers are disposed to define an open area from which sound energy generated by the drivers can be emitted.

15 Claims, 5 Drawing Sheets

TWO-WAY QUASI POINT-SOURCE WIDE-DISPERSION SPEAKER

CROSS-REFERENCE TO RELATED APPLICATIONS

This disclosure claims the benefit of priority to U.S. Provisional Application No. 62/824,518 filed Mar. 27, 2019, the disclosure of which is incorporated herein in its entirety.

BACKGROUND

Field of the Invention

The invention relates to an array of speakers disposed to propagate sound in a manner that simulates sound emanating from a point source.

Related Art

U.S. Pat. No. 8,249,268 relates to a woofer-less loudspeaker system that has a plurality of tweeter drivers arranged in a spherical or part spherical array so that each tweeter driver faces out from a center of the sphere and with the axis of symmetry of each tweeter driver defining a radius of the sphere. Sound energy then is directed radially out in all radial directions from the center of the sphere or in a number of radial directions corresponding to the part spherical array. The loudspeaker system disclosed in U.S. Pat. No. 8,249,268 is very effective in situations where it is desirable to have sound waves generated out uniformly in all directions or in a plurality of directions from an apparent single point source.

U.S. Pat. No. 8,917,881 relates to an audio speaker system with a plurality of tweeter drivers arranged in a spherical array so that each tweeter driver faces in toward the center of the sphere and with the axis of symmetry of each tweeter driver defining a radius of the sphere. Sound energy then is directed radially in all radial directions toward the center of the sphere. The sound waves from the spherical array of tweeter drivers merge at the center of the sphere, recombine and then are re-emitted outward in all directions as if the center point of the sphere is a point source of all outgoing soundwaves. It has been found that the speaker system disclosed in U.S. Pat. No. 8,917,881 is very effective in some environments but less effective in many other environments. For example, speakers often are mounted on or very close to one or more walls. In these situations, at least half of the re-emitted soundwaves emanating from the center of the sphere are directed toward the wall and reflect from the wall at a plurality of angles and a plurality of positions. Thus, the desired effect of having the sound waves appear to emanate from a point source is lost in the many situations where the spherical array of tweeter drivers are mounted in proximity to a wall. As a result, there are phase shifts in the sound waves reaching the listener due to the different distances that the sound waves travel from the respective tweeter drivers with or without reflections from the wall and from different points of reflection from the wall. The various waves form addition and cancellation interference with one another in those situations with a potentially significant reduction in the quality of the sound reaching the listener.

In view of the above, an object of the subject invention is to provide a speaker system configured to allow sound to be perceived by a listener as being directed outward from an apparent point source.

SUMMARY

The invention relates to a speaker system comprising at least one part-spherical array of speakers. Each speaker includes a front face from which sound is emitted and a rear face opposite the front face. An axis of symmetry extends concentrically through the front and rear faces of each speaker. The axes of symmetry of the speakers in the array extend radially through a center point of a sphere, and with the front face of each of the speakers facing toward the center point of the sphere. The speakers in the at least one array form part of a sphere. For example, the part spherical array of speakers may define a hemisphere or an array smaller or larger than a hemisphere. More particularly, an open area is formed in the spherical array. A plane passing through the center of the sphere and bisecting the open area may circumscribe a sector that spans an angle of 30°-180° or more. Sound energy emitted from the speakers will be directed toward the center of the sphere, will merge at the center, recombine and be emitted from the open area in a directional manner that is perceived as emanating from the center of the sphere.

The various speakers may be mounted in a structure intended to minimize vibration in the structure and thus minimizing any sound produced by such vibration. Additionally, the mounting structure for the speakers may have appropriate sealing material and/or insulation to minimize sound produced by the speakers from being transmitted through the mounting structure and in a direction away from the opening in the part spherical array.

In one embodiment, the speakers in the speaker array comprise or consist of tweeter drivers. In another embodiment, the speakers in the speaker array comprise tweeter drivers and midrange drivers. The tweeter drivers and the midrange drivers may be disposed at substantially identical radial distances from the center of the sphere. Additionally, the tweeter drivers and the midrange drivers may be disposed in a specified circumferential pattern, such as an alternating arrangement of tweeter drivers and midrange drivers.

The at least one part-spherical array of speakers may comprise at least first and second part-spherical arrays of speakers. The first part-spherical array of speakers may comprise speakers at a first radial distance from the center of the sphere, while the second part-spherical array of speakers may comprise speakers at a second radial distance from the center of the sphere, with the first and second radial distances being different from one another. The speakers in the first part spherical array may be different from the speakers in the second part-spherical array. For example, tweeter drivers may be disposed in the first part-spherical array, with the tweeter drivers being at a first radial distance from the center of the sphere. Midrange drivers may be disposed in the second part spherical array with the midrange drivers being at a second radial distance from the center of the sphere. The second radial distance may be greater than the first radial distance. Additionally, the drivers in the first and second part-spherical arrays are offset circumferentially from one another so that the drivers in the array closer to the center of the sphere do not impede sound energy emitted from the drivers in the second part spherical array. Thus, the sound energy emanating from both part-spherical arrays may reach the center point substantially unimpeded. This sound energy will merge and be emitted from the open area in the array.

DETAILED DESCRIPTION

Figure 1:
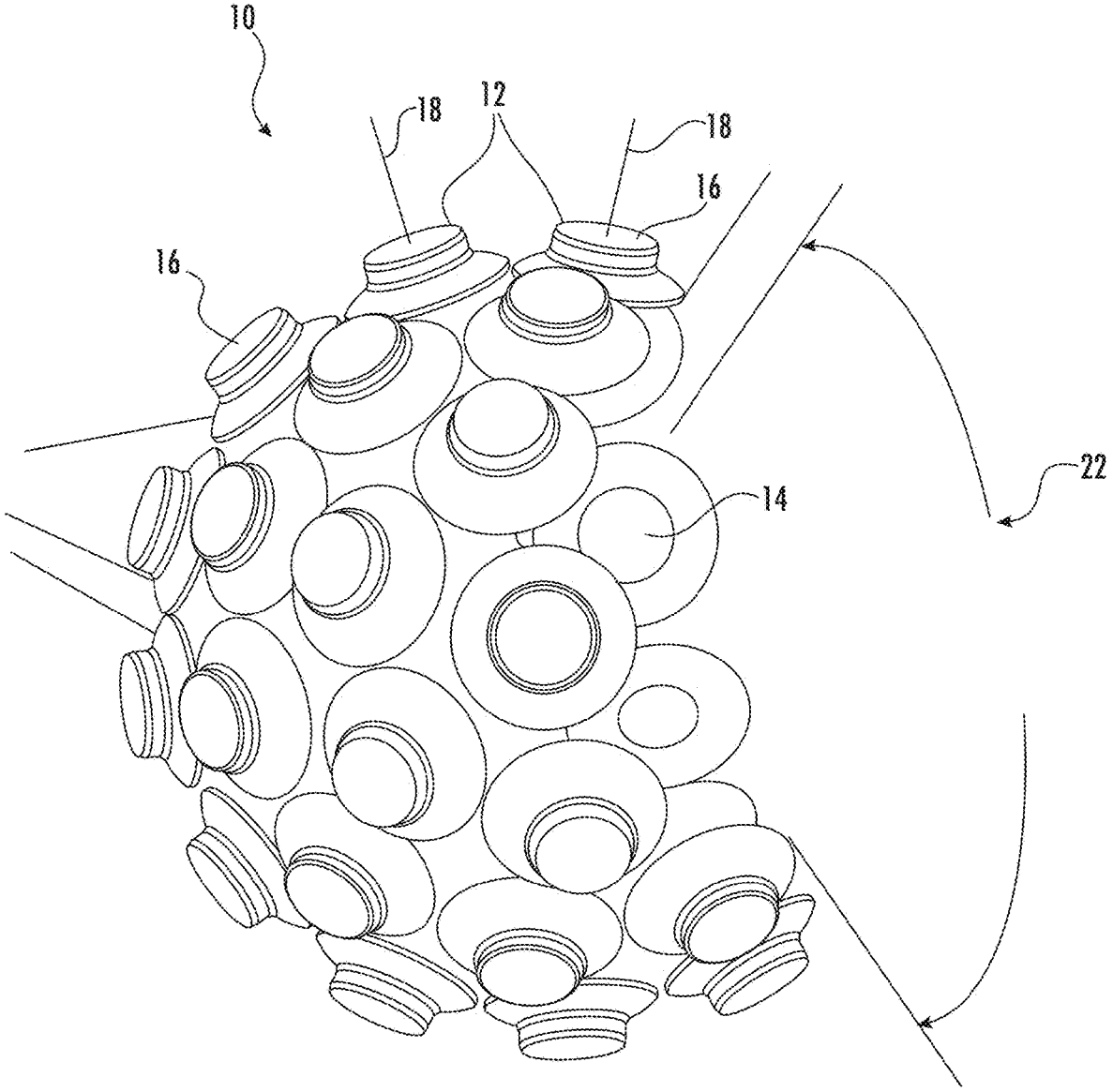
FIG. 1 is a side elevational view of a part-spherical array of speaker drivers in accordance with a first embodiment.

FIG. 1 illustrates a part-spherical speaker array 10 comprised of a plurality of drivers 12. Each driver 12 has opposite front and rear faces 14 and 16 disposed along an axis 18. The drivers 12 are oriented so that the axes 18 intersect a common center point and are oriented so that the front faces 14 of all of the drivers 12 face toward the common center point. The common center point is not visible in FIG. 1, but is visible in the second and third embodiments illustrated in FIGS. 2 and 3 and described below. Additionally, in the embodiment of FIG. 1, the front faces 14 of the drivers 12 are at the same radial distance from the common center point. Thus, the front faces 14 of the drivers 12 are disposed in a spherically generated array. However, the array 10 of drivers do not form a complete sphere. Rather, the drivers 12 are disposed to leave an open area 22 for dispersion of sound from the drivers 12 of the array 10. With this arrangement, sound energy produced from the plurality of drivers 12 is directed toward the center point of the part-spherical array 10. The sound energy will merge at the center point, combine and be re-emitted from the open area 22 as if the sound all emanated from the center point of the part-spherical array 10.

Figure 2:
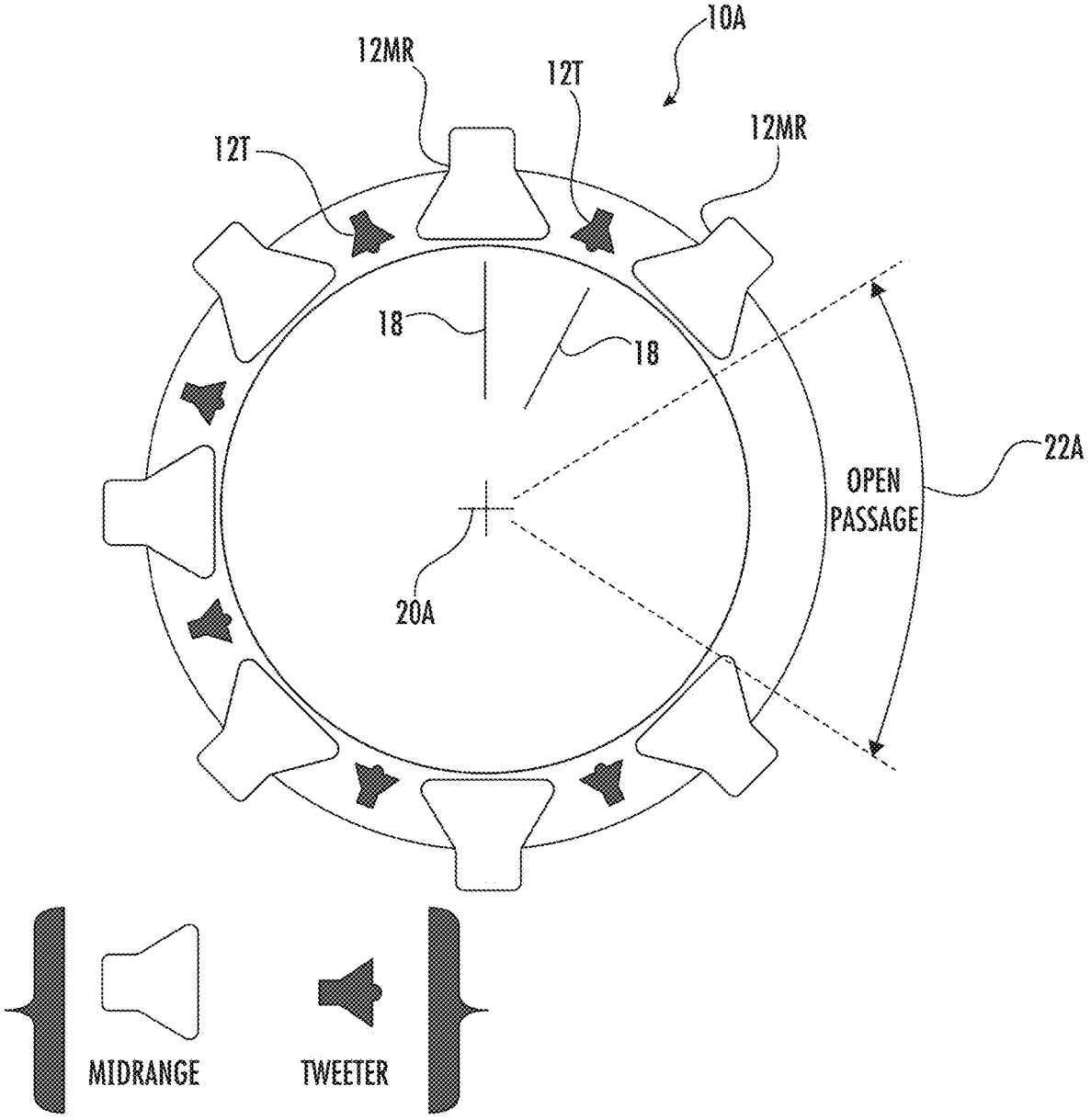
FIG. 2 is a schematic cross-sectional view of a part-spherical array of speakers in accordance with a second embodiment.

FIG. 2 illustrates a second embodiment that differs from the first embodiment with respect to the types of drivers that comprise the array. More particularly, FIG. 2 illustrates a speaker array 10A comprised of tweeter drivers 12T and midrange drivers 12MR. The axes 18 of the tweeter drivers 12T and the midrange drivers 12MR all are aligned radially with respect to the center point 20A, and the front faces 14T and 14MR are equidistant from the center point 20A to define a single part-spherical array 10A. However, an open area 22A is defined on one side of the part-spherical array 10A and spans an angle of approximately 45°. Smaller or larger angles for the open area 22A are possible. In most embodiments, the open area will span an angle of 180° or less. However, an open angle of greater than 180° is possible. As in the first embodiment, sound emitted from the tweeter drivers 12T and midrange drivers 12MR will meet at the center point 20A, merge and be emitted from the open area 22A while creating an acoustical impression that the sound all emanates from the center point 22A.

Figure 3:
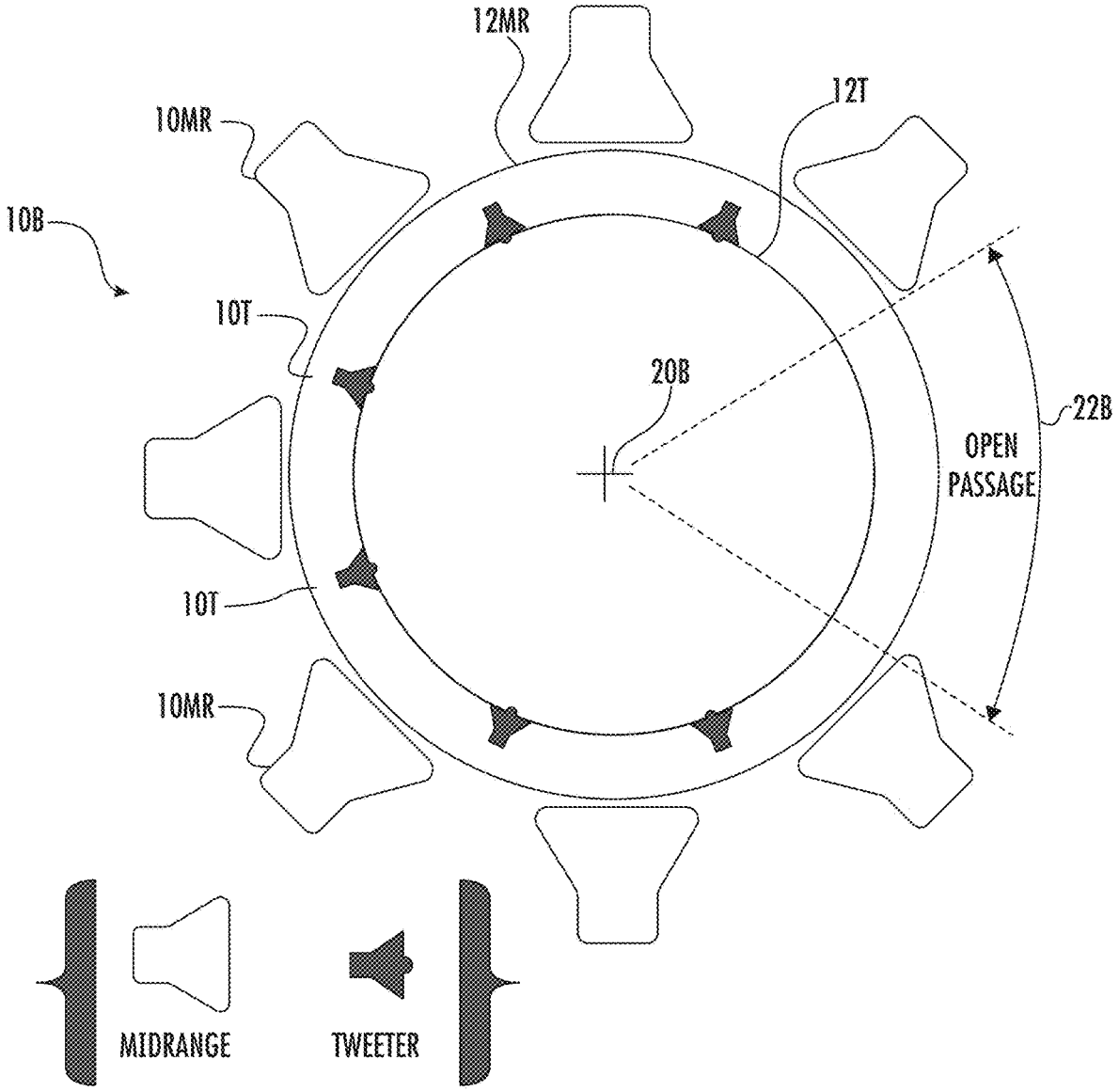
FIG. 3 is a schematic cross-sectional view of a part-spherical array of speakers in accordance with a third embodiment.

FIG. 3 shows a third embodiment that is a variation of the second embodiment. More particularly, FIG. 3 illustrates a part-spherical array 10B comprised of tweeter drivers 12T and midrange drivers 12MR all of which have axes that form radii intersecting at a center point 20B. However, the tweeter drivers 12T have front faces 14T spaced at a first radial distance from the center point 20B, while the midrange drivers 12MR have front faces 14MR spaced at a second radial distance from the center point 20B, with the second radial distance being greater than the first radial distance. As a result, the part-spherical array 10B of the second embodiment has first and second part-spherical arrays 10T and 10MR. The tweeter drivers 12T in the first part spherical array 10T are at circumferential positions offset from the midrange drivers 12MR in the second part-spherical array 10MR. Thus, the tweeter drivers 12T will not impede sound energy emitted from the midrange drivers 12MR so that all of the sound energy will be directed to the center point 20B. As in the previous embodiments, the sound energy will merge at the center point 20B, recombine and exit via the open area 22B.

Figure 4:
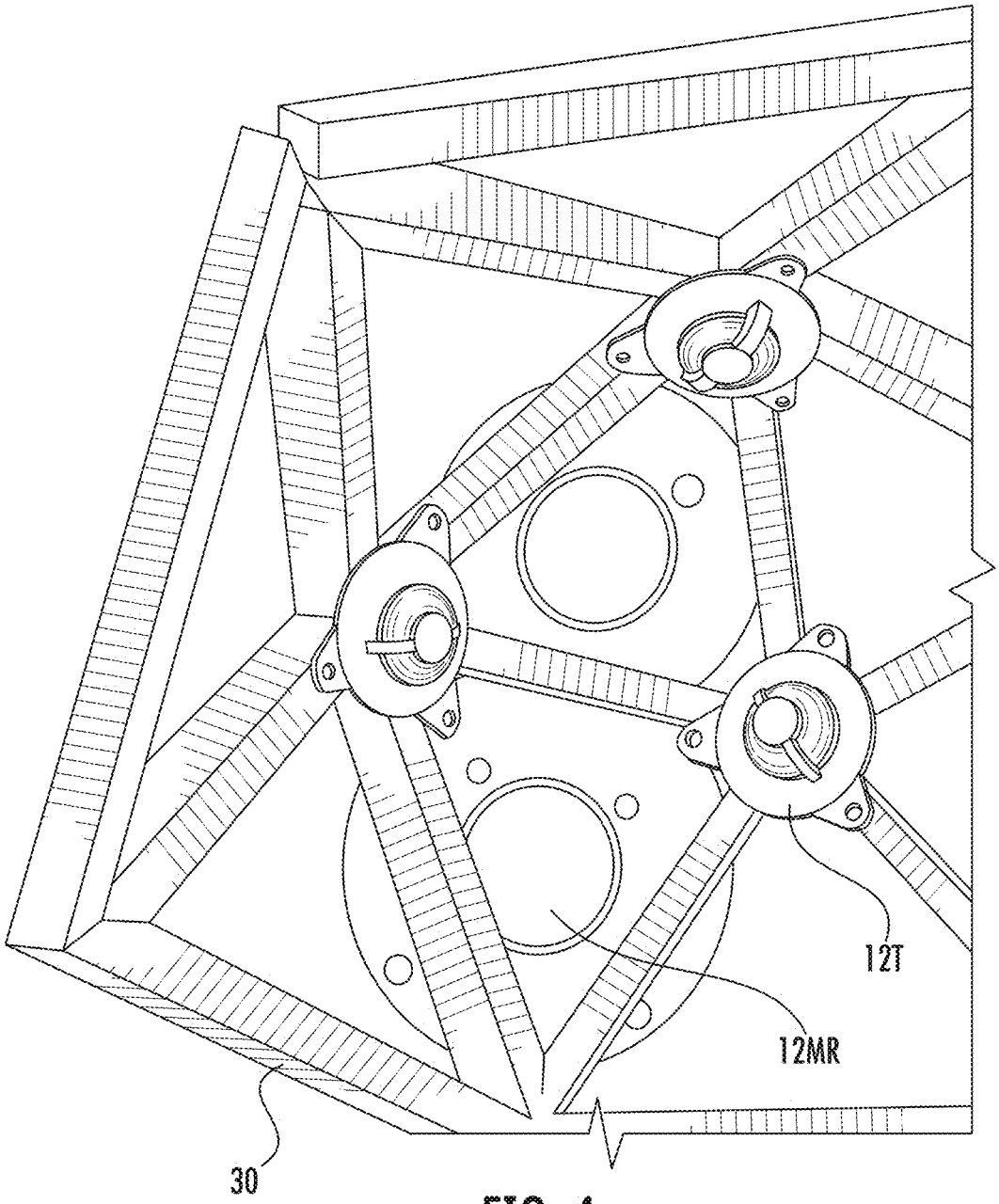
FIG. 4 is a front elevational view of a variation of the third embodiment at an intermediate stage of manufacture.
Figure 5:
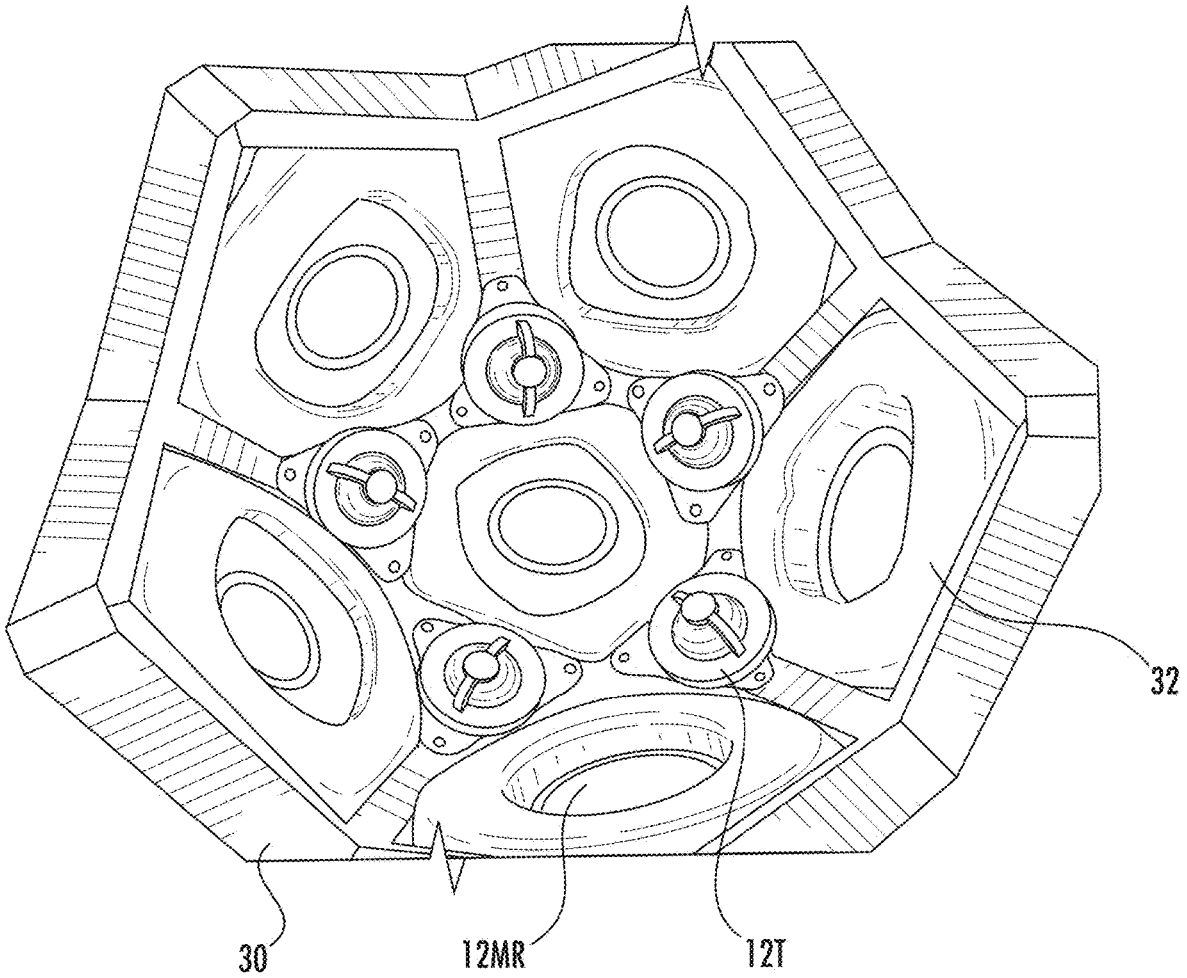
FIG. 5 is a front elevational view of the embodiment illustrated in FIG. 4 at a subsequent stage of manufacture.

FIGS. 4 and 5 illustrate various stages of manufacturing a part-spherical speaker array 10B in accordance with one possible manufacturing approach. More particularly, a frame 30 substantially in the form of a part geodesic dome is formed from appropriate rigid materials such as wood or resin, as illustrated in FIG. 4. The tweeter drivers 12T are affixed securely to inwardly facing surfaces of the frame 30. The midrange drivers are affixed securely to outer surfaces of the frame 30. The front faces of the tweeter drivers 12T and the front faces of the midrange drivers 12MR all face inward toward the center point 20B. A sealing material and insulation 32 then is mounted to the frame 30 to prevent sound energy from the tweeter drivers 12T and the midrange drivers 12MR from emanating through areas between the tweeter drivers 12T and the midrange drivers 12MR.

The invention has been described with respect to certain specific embodiments. However, it is apparent that various changes can be made without departing from the scope of the invention. For example, the number and types of drivers can be varied. Additionally, the size of the open area from which the sound is emitted can be varied. Still further, the frame can take many different forms.

What is claimed is:

1. A speaker system comprising:

a plurality of drivers, each of the plurality of drivers including a front face and a rear face with an axis of symmetry extending from the front and rear faces of each of the drivers, each of the drivers being configured for propagating sound energy from the front face and along the axis of symmetry; and a frame supporting the drivers so that the axes of symmetry of the drivers converge at a single center point with the front faces of the drivers facing toward the single center point so that the drivers define at least one spherically generated array of the drivers relative to the single center point, the frame and the drivers being disposed to define an open area to accommodate a propagation of the sound energy from the frame and the spherically generated array of the drivers, wherein the drivers include a plurality of tweeter drivers and a plurality of midrange drivers.

2. The speaker system of claim 1, wherein the front faces of the drivers are equidistant from the center point.

3. The speaker system of claim 1, wherein the front faces of tweeter drivers are at a first distance from the center point and the front faces of the midrange drivers are at a second distance from the center point, the second distance being different from the first distance so that the tweeter drivers define a first spherically generated array of drivers concentric with respect to the center point and so that the midrange drivers define a second spherically generated array of drivers concentric with the center point.

4. The speaker system of claim 3, wherein the second distance is greater than the first distance.

5. The speaker system of claim 4 wherein the tweeter drivers are offset circumferentially from the midrange drivers so that the tweeter drivers do not impede sound energy emitted from the midrange drivers.

6. The speaker system of claim 1, wherein the frame has a concave inner surface and a convex outer surface, the tweeter drivers being mounted to the concave inner surface of the frame and the midrange drivers being mounted to the convex outer surface of the frame.

7. The speaker system of claim 1, further comprising a sealing material mounted to the frame for substantially preventing sound energy from being emitted through the frame.

8. The speaker system of claim 1, wherein the open area defined by the frame and the drivers to accommodate the propagation of the sound energy from the frame and the spherically generated array of the drivers spans an angle of from 30° to less than 180°.

9. A speaker system, comprising:

a plurality of drivers, each of the plurality of drivers including a front face and a rear face with an axis of symmetry extending from the front and rear faces of each of the drivers, each of the drivers being configured for propagating sound energy from the front face and along the axis of symmetry; and a frame supporting the drivers so that the axes of symmetry of the drivers converge at a single center point with the front faces of the drivers facing toward the single center point so that the drivers define at least one spherically generated array of the drivers relative to the single center point, the frame and the drivers being disposed to define an open area to accommodate a propagation of the sound energy from the frame and the spherically generated array of the drivers, wherein the open area spans a sector defined by radii extending from the center point, the sector formed by the open area defining an angle of at least 45°.

10. The speaker system of claim 9, wherein the sector formed by the open area defines an angle of less than 180°.

11. The speaker system of claim 10, wherein the front faces of tweeter drivers are at a first distance from the center point and the front faces of the midrange drivers are at a second distance from the center point, the second distance being different from the first distance so that the tweeter drivers define a first spherically generated array of drivers concentric with respect to the center point and so that the midrange drivers define a second spherically generated array of drivers concentric with the center point.

12. The speaker system of claim 11, wherein the second distance is greater than the first distance.

13. The speaker system of claim 12, wherein the tweeter drivers are offset circumferentially from the midrange drivers so that the tweeter drivers do not impede sound energy emitted from the midrange drivers.

14. The speaker system of claim 9, wherein the front faces of the drivers are equidistant from the center point.

15. The speaker system of claim 9, wherein the drivers include a plurality of tweeter drivers and a plurality of midrange drivers.

* * * * *